United States Patent [19]

Toshima

[11] Patent Number: 4,531,135

[45] Date of Patent: Jul. 23, 1985

[54] THERMAL TRANSFER TYPE PRINTING APPARATUS

[75] Inventor: Akira Toshima, Yokohama, Japan

[73] Assignee: Kabushiki Kaisha Toshiba, Kawasaki, Japan

[21] Appl. No.: 623,566

[22] Filed: Jun. 22, 1984

[30] Foreign Application Priority Data

Jun. 30, 1983 [JP] Japan ..... 58-117050

[51] Int. Cl.[3] ..... B41J 3/10

[52] U.S. Cl. ..... 346/76 PH; 346/1.1

[58] Field of Search ..... 346/76 R, 76 PH, 1.1; 219/216, 216 PH; 400/120, 197, 200, 202, 227.1, 227.2, 695; 355/16

[56] References Cited

U.S. PATENT DOCUMENTS 4,359,748 11/1982 Pasini et al. ..... 346/76 PH 4,407,002 9/1983 Inui et al. ..... 346/76 PH

*Primary Examiner*—Thomas H. Tarcza

*Assistant Examiner*—A. Evans

*Attorney, Agent, or Firm*—Cushman, Darby & Cushman

[57] ABSTRACT

A thermal transfer type printing apparatus includes a thermal head constituted by a number of heating elements and is closely contacted with an ink ribbon. The thermal head is driven in accordance with print information to transfer the ink layer of the ink ribbon fed from an ink ribbon feeding reel to a paper. The negative formed on the ink ribbon due to the ink transferring is erased by the thermal head whose heating elements are driven while the ink ribbon is rewinded to an ink ribbon feeding reel.

11 Claims, 11 Drawing Figures

THERMAL TRANSFER TYPE PRINTING APPARATUS

BACKGROUND OF THE INVENTION

This invention relates to a printing apparatus, and more particularly to a thermal transfer type printing apparatus using a thermal head and thermal transfer ink.

A thermal transfer type printing apparatus reduced in size and weight dispenses with maintenance and so is widely used with, for example, a facsimile system or copying machine. With the conventional thermal transfer type printing apparatus so designed that an ink ribbon is pressed against a sheet of paper by a thermal head, an ink layer of the ink ribbon is transferred onto a paper surface in accordance with the contents of the print information received. The ink ribbon whose ink layer has already been transferred is taken up on a reel. However, the conventional thermal transfer type printing apparatus has the drawbacks that an ink ribbon taken up on a reel still retains an ink-removed portion corresponding to the print information received. This ink-removed portion remains visible as a negative, thereby enabling the print information to be read from the transferred ink ribbon, thus raising an important problem from the standpoint of keeping the secrecy of the print information.

SUMMARY OF THE INVENTION

It is accordingly the object of this invention to provide a thermal transfer type printing apparatus which obstructs the reading of a negative image left on the ink ribbon after the transfer of the ink layer.

To attain the above-mentioned object, this invention provides a thermal transfer type printing apparatus which comprises a thermal head formed of a number of heating elements, and a thermal head driver which is operated in accordance with the contents of the print information received.

The negative on the transferred ink ribbon which corresponds to the print information is completely erased by the operation of all the heating elements of the thermal head.

DETAILED DESCRIPTION OF THE PREFERRED EMBODIMENTS

Figure 1:
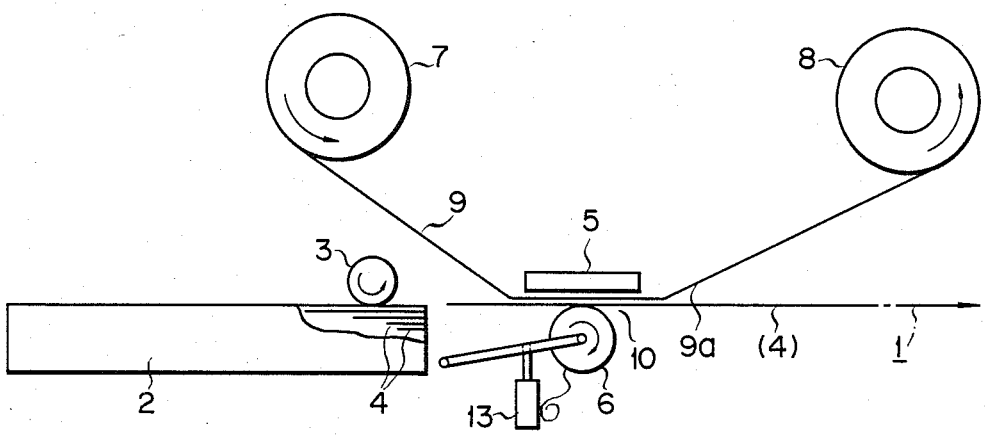
FIG. 1 schematically shows the main portions of a thermal transfer type printing apparatus according to a first embodiment of this invention.

Referring to the main portions of the thermal transfer type printing apparatus, a paper cassette 2 is made detachable from the printing apparatus. The paper cassette 2 holds the paper sheets to be printed. The uppermost paper sheet is pressed against a paper-feeding roller 3. The paper sheets 4 are conducted to a paper transportation path 1 one after another by the rotation of the roller 3. A thermal head 5 and platen 6 are symmetrically set with respect to the paper transportation path 1.

Figure 2:
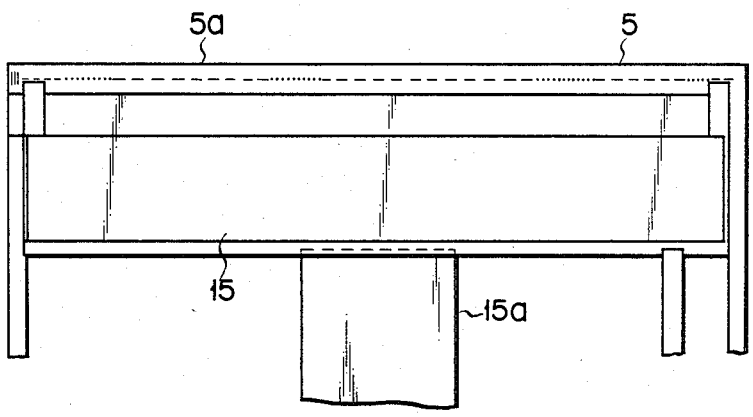
FIG. 2 is a plan view of a thermal head.

The thermal head 5 is formed of numerous (for example, 1728) heating elements 5*a* as shown in FIG. 2. The heating elements are selectively energized by a thermal head driver according to the contents of input data supplied through a lead cable 15*a*.

An ink ribbon 9 is made to travel through an interstice defined between the thermal head 5 and plate 6. The ink ribbon 9 is taken up on an ink ribbon-feeding reel 7, and, after being delivered from the ribbon-feeding reel 7, the ink ribbon 9 is again wound about a ribbon take-up reel 8. The platen 6 is connected to a solenoid 13, and is pressed against the thermal head 5 or detached therefrom in accordance with the manner in which the solenoid 13 is energized.

Figure 3:
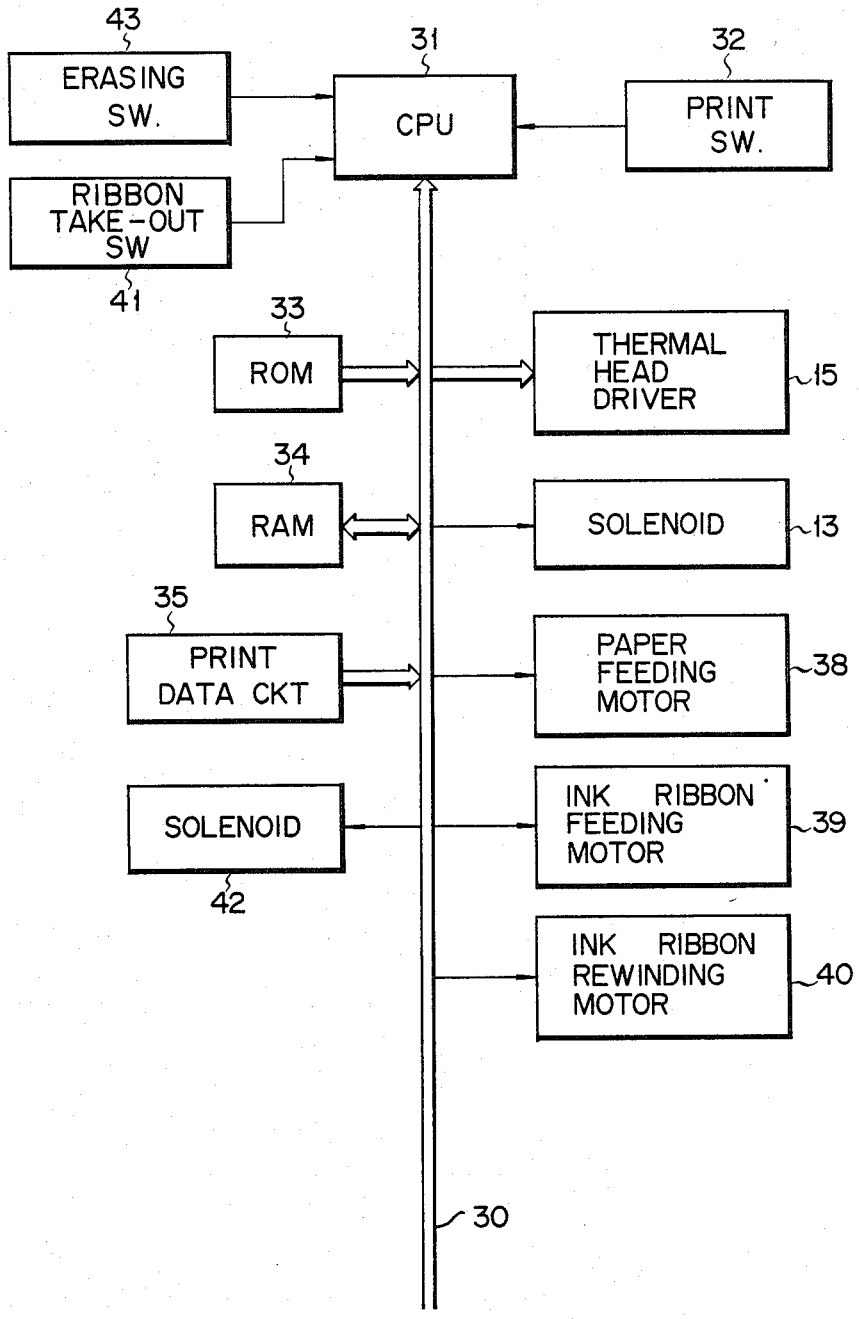
FIG. 3 is a block circuit diagram of the thermal transfer type printing apparatus embodying the invention.

Referring to FIG. 3 showing the electric circuit system of the subject printing apparatus, CPU 31 is connected to a start switch 32, and also to ROM 33 and RAM 34 through a bus line 30. ROM 33 stores the program for the printing operation, and RAM 34 stores various kinds of data. A print data circuit 35 is connected to a thermal head driver 15 through the bus line 30. The print data circuit 35 is constituted by, for example, a scanner of a copying machine or an image information memory of a facsimile system. Print data is supplied to the thermal head driver 15 through the bus line 30. This bus line 30 is connected to the solenoid 13, paper-feeding motor 38, ink ribbon-feeding motor 39, and ink ribbon-rewinding motor 40, and is controlled by CPU 31.

A description may now be made of a thermal transfer type printing apparatus according to a first embodiment of this invention. When the power source of the printing apparatus is rendered conducting, and the start switch 32 is closed, then printing commences. At this time, a paper-feeding roller 3 is rotated, and a paper sheet is sent from the paper cassette 2 to the paper transportation path 1. The ink ribbon-feeding motor 39 is rotated to draw off the ink ribbon 9 from the ink ribbon reel 7. The paper sheet 4 travels through the paper transportation path 1 while being tightly attached to the ink ribbon 9. When the paper sheet 4 reaches a printing section, that is, an interstice defined between the thermal head 5 and platen 6, then the thermal head driver 15 issues drive signals to the thermal head 5 in accordance with the contents of print data supplied from the print data circuit 35. The heating elements of the thermal head 5 are selectively energized in accordance with the contents of the drive signals. Ink dots corresponding to the energized heating elements are thermally transferred to the paper sheet 4. That is, dots are printed on the paper sheet in accordance with the contents of print data. After passing through the printing section 10, the paper sheet 4 is separated from the ink ribbon 9 and forwarded to a print tray (not shown). After transfer, the ink ribbon 9 is again wound about the take-up reel 8.

Figure 4:
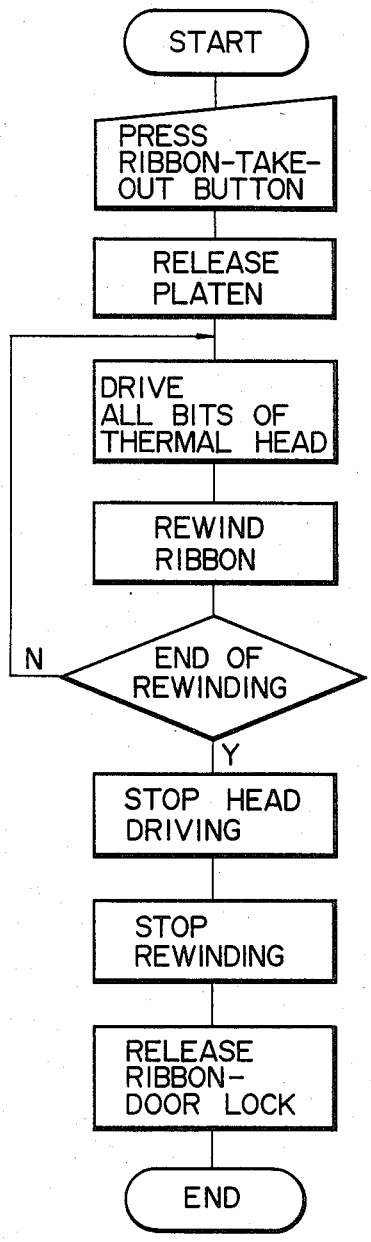
FIG. 4 is a flow chart illustrating the operation of erasing a negative.
Figure 8:
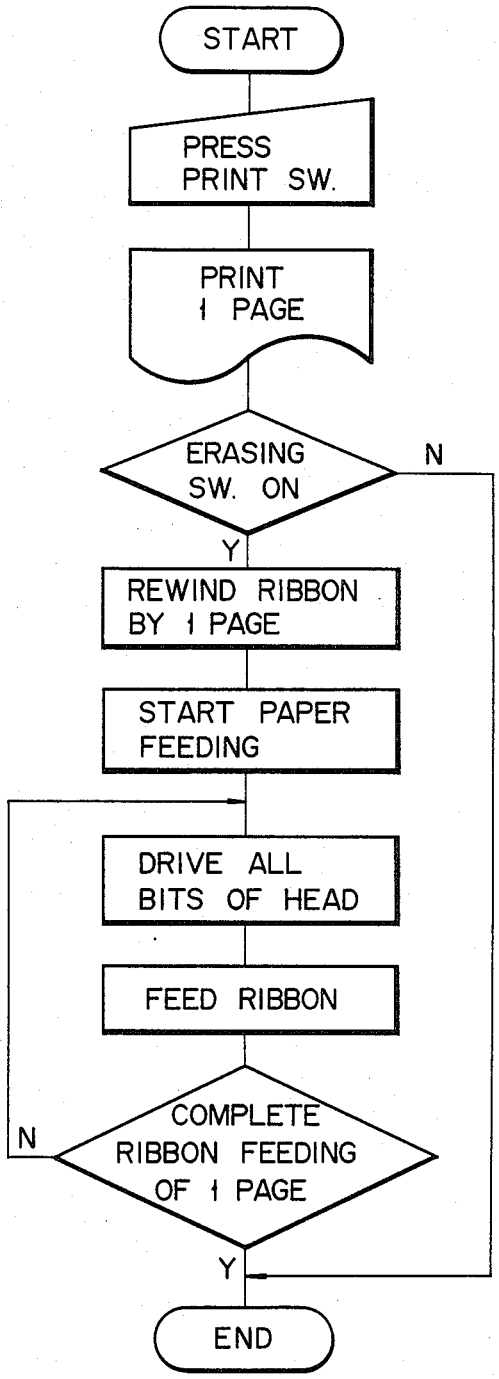
FIG. 8 is a flow chart illustrating the negative erasing operation of a thermal transfer type printing apparatus according to a third embodiment of the invention.
Figure 5:
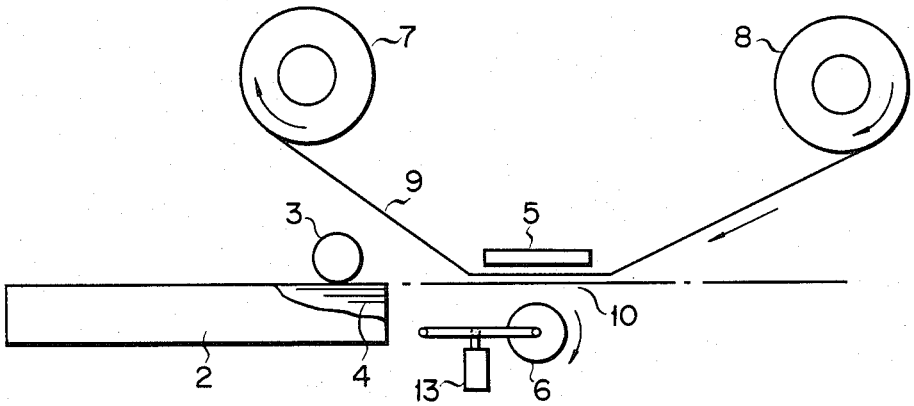
FIG. 5 shows the main portions of the subject thermal transfer type printing apparatus while a negative on the ink ribbon is being erased.

When printing is then successively carried out by applying all of the ink ribbon 9, and the ink ribbon 9 now retaining the negative is all wound about the take-up reel 8, then a negative erasing operation ensues. This erasing operation is carried out in conformity with the flow chart of FIG. 4. When a ribbon-take-out switch 41 is closed after a start instruction has been issued, the solenoid 13 is energized to remove the platen 6 from the thermal head 5. Thereafter, the drive signals for energizing all the heating elements 5*a* of the thermal head 5 are supplied by the thermal head driver 15 to the thermal head 5. At this time, the ink ribbon rewinding motor 40 is driven to rewind the ink ribbon about the ink ribbon-feeding reel 7 as shown in FIG. 5. During this rewinding operation, the ink layer of the ink ribbon 9 is all melted away by the heat generated by the thermal head 5 to erase the negative on the ink ribbon 9.

Figure 6:
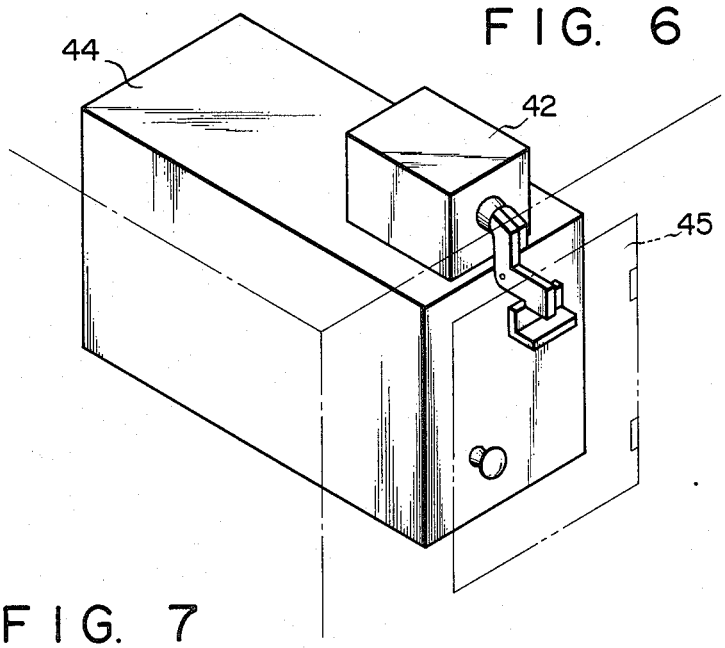
FIG. 6 shows a perspective view of a locking mechanism section.

When the ink ribbon 9 is rewound, the thermal head 5 and rewinding motor 40 cease operating. Later a locking solenoid 42 is energized. The locking solenoid 42 is used for locking a door 45 provided on a shelf in which an ink ribbon cassette 44 is received, as shown in FIG. 6. When the solenoid 42 is energized, the lock of the door 45 is released for permitting the door to open, thereby allowing for the withdrawal of the erased ink ribbon. Namely, it is impossible to take out an ink ribbon whose negative has not yet been extinguished, thereby preventing the appearance of an ink ribbon whose negative has not yet been erased.

Figure 7:
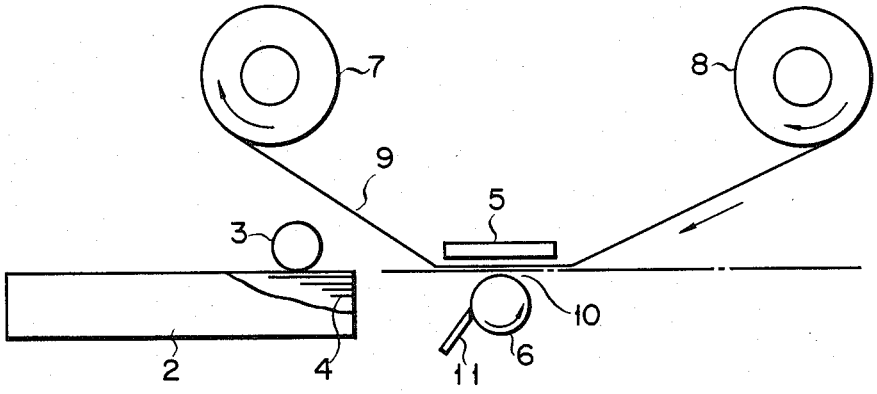
FIG. 7 schematically sets forth the main portions of a thermal transfer type printing apparatus according to a second embodiment of the invention.
Figure 9A:
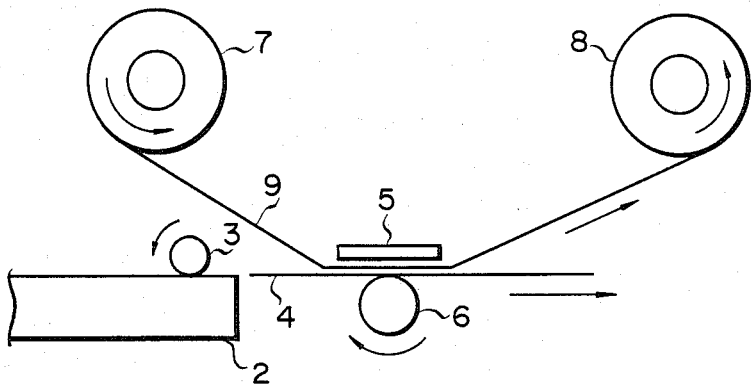
FIGS. 9A to 9C schematically show the main portions of a printing apparatus built in accordance with the flow chart of FIG. 7.
Figure 9B:
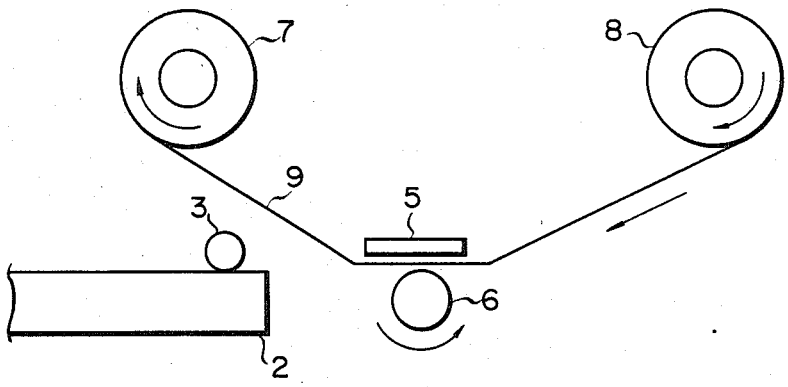
Figure 9C:
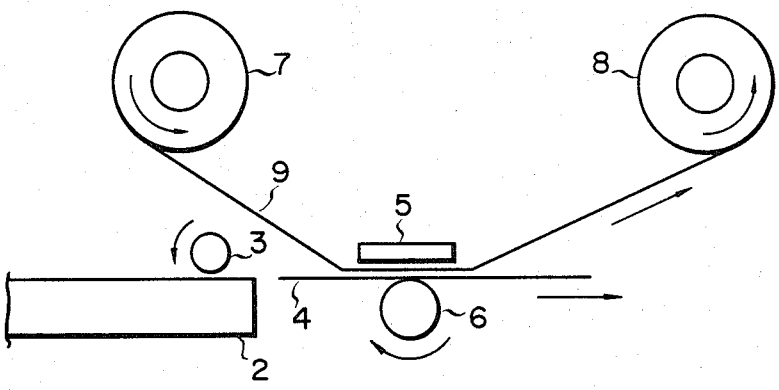

Referring to FIG. 7 showing the second embodiment of this invention, the platen 6 is pressed against the thermal head 5 with the ink ribbon 9 interposed therebetween even during the erasing operation. According to this second embodiment, the ink layer melted by the thermal head 5 is substantially completely transferred to the surface of the platen 6, thereby erasing the negative from the ink ribbon 9. The ink transferred to the platen 6 is removed by a cleaning blade 11 pressed against the surface of the platen 6.

A description may now be made with reference to FIGS. 8, and 9A to 9C of a thermal transfer printing apparatus according to a third embodiment of this invention. This third embodiment is provided with an erasing switch 43 (see FIG. 3). This erasing switch 43 is operated, if necessary. When the print switch 32 is first pressed to start printing, and the printing of one paper sheet is brought to an end in accordance with the process described with respect to the first embodiment, then CPU 31 checks the condition of the erasing switch 43. If the erasing switch 43 is operated, CPU 31 drives the ink ribbon rewinding motor 40 to rewind that portion of the ink ribbon which corresponds to the paper sheet. When the rewinding of that portion of the ink ribbon which corresponds to one paper sheet is brought to an end, then the paper-feeding roller 3 draws off a paper sheet 4 from the cassette 2. The paper sheet 4 is transported to the printing section 10 while being closely attached to that rewound portion of the ink ribbon which corresponds to one paper sheet. At this time, all the heating elements 5*a* of the thermal head 5 are energized, that is, all the bits of the thermal head 5 are driven. When, therefore, the paper sheet 4, together with the ink ribbon 9, passes along the thermal head 5, the negative of the ink ribbon 9 is substantially completely transferred to the paper sheet 4, thereby preventing the negative from being retained on the ink ribbon 9. Thus the negative of the ink ribbon 9 is completely erased. When the extinction of the negative on that portion of the ink ribbon 9 which corresponds to one paper sheet is brought to an end, the erasing operation ceases, rendering the subject printing apparatus ready for the succeeding printing mode. The paper sheet to which a negative has been transferred is carried to a print tray (not shown) to which a normal print is brought. When observing a negative bearing paper sheet, the operator can confirm that the ink ribbon no longer retains a negative corresponding to the previously supplied print information. With the above-mentioned third embodiment, it is possible to transfer a negative impression to the platen 6 and to remove the ink corresponding to the negative image by means of a cleaning blade.

As mentioned above, this invention offers the advantage that the tranferred negative of the ink ribbon is erased when the whole ink ribbon is heated by operating all the bits of the thermal head, thereby preventing printed information from being divulged from the used ink ribbon.

Throughout the foregoing embodiments, all the heating elements of the thermal head were operated during the erasing mode. However, it is possible to energize only a sufficient number of the heating elements of the thermal head to render a negative unreadable.

What is claimed is:

1. A thermal transfer type printing apparatus comprising:

a printing section fitted with thermal head means which is constituted by a large number of heating elements and is tightly pressed against an ink medium provided with an ink layer;

ink medium-transporting means for forwarding the ink medium;

means for feeding a material to be printed to said printing section;

means for issuing print information;

thermal head-driving means which selectively operates the heating elements of the thermal head means in a print mode in accordance with the contents of the print information from the print information-issuing means; and means for specifying an erasing mode, following cessation of said print mode to render unreadable a remaining image corresponding to print information which has been retained on the transferred ink medium, and, when said erasing mode is set, issues a signal to said thermal head driving means to actuate the heating elements of the thermal head.

2. The printing apparatus according to claim 1, wherein said ink medium-transporting means is formed of ink ribbon-feeding reel means for conveying an ink ribbon applied as the ink medium, and ink ribbon take-up reel means to take up a transferred ink ribbon; and said erasing mode-specifying means drives all the heating elements of the thermal head means and issues a signal for the reverse drive of the ink ribbon-feeding reel means in order to rewind the transferred ink ribbon about said reel means.

3. The printing apparatus according to claim 1, wherein said printing section comprises platen means which is made to face said thermal head means with said ink medium interposed therebetween and can move toward said thermal head to press the material to be printed against said thermal head.

4. The printing apparatus according to claim 1, wherein said ink medium-transporting means is formed of ink ribbon-feeding reel means for transporting an ink ribbon applied as said ink medium and take-up reel means for taking up said ink ribbon remaining as the transferred in medium; said erasing mode-specifying means drives all the heating elements of said thermal head means, and issues a signal for the reverse drive of said ink ribbon feeding reel means in order to rewind the transferred ink ribbon about said ink ribbon feeding reel means; said printing section comprises said platen means which is made to face said thermal head means with said ink ribbon interposed therebetween and cleaning blade means pressed against said platen means; and said cleaning blade means removes an ink layer transferred to said platen means.

5. The printing apparatus according to claim 1, wherein said thermal head-driving means drives said thermal head means to impress print information on each material to be printed; and said erasing mode-specifying means supplies said thermal head driving means with a signal for transferring a remaining image to the material to be printed in order to erase said remaining image for each paper sheet.

6. The printing apparatus according to claim 1, wherein said ink medium-transporting means comprises means for locking the withdrawal of said ink medium and means for releasing said locking means upon receipt of a signal denoting the termination of said erasing mode.

7. A thermal transfer printing method comprising a tranferring process for transferring the ink layer of the thermal transfer ink ribbon to a to-be-printed matter by a thermal head, and an erasing process for transporting again the ink ribbon into said thermal head after transferring thereby rendering the negative image remaining on the ink ribbon unreadable.

8. The thermal transfer printing method according to claim 7, wherein said erasing process is a process of heat-fusing the ink ribbon by said thermal head.

9. The thermal transfer printing method according to claim 7, wherein said erasing process is a process of transferring substantially all of the ink layer of the ink ribbon into a member.

10. The thermal transfer printing method according to claim 7, wherein said erasing process is a process for transferring substantially all of the ink layer of the ink ribbon into a platen contacted with the ink ribbon.

11. The thermal transfer printing method according to claim 9, wherein said erasing process is a process for transferring substantially all of the ink layer of the ink ribbon into a paper sheet.

* * * * *